United States Patent [19]

Smith, Jr.

[11] Patent Number: 4,649,868

[45] Date of Patent: Mar. 17, 1987

[54] SLUDGE TRAP WITH INTERNAL BAFFLES FOR USE IN NUCLEAR STEAM GENERATOR

[75] Inventor: Allen C. Smith, Jr., Bethel Park, Pa.

[73] Assignee: Westinghouse Electric Corp., Pittsburgh, Pa.

[21] Appl. No.: 677,767

[22] Filed: Dec. 3, 1984

[51] Int. Cl.[4] ..... F22B 37/54; B01D 19/00

[52] U.S. Cl. ..... 122/32; 122/379; 122/381; 122/382; 122/405; 210/521

[58] Field of Search ..... 122/32, 34, 379, 361, 122/381, 382, 363, 390, 405; 210/521

[56] References Cited

U.S. PATENT DOCUMENTS

| | | | |
|---|---|---|---|
| Re. 29,397 | 9/1977 | Yamazaki | 210/521 |
| 1,238,773 | 9/1917 | Illescas . | |
| 2,024,564 | 12/1935 | Brand | 122/405 |
| 2,119,013 | 5/1938 | Kerns et al. | 210/57 |
| 3,331,510 | 7/1967 | Arnold | 210/187 |
| 3,552,554 | 1/1971 | Olgard | 210/519 |
| 3,661,123 | 5/1972 | Romanos | 122/34 |
| 3,668,838 | 6/1972 | McNeil et al. | 122/381 |
| 3,916,844 | 11/1975 | Cassell | 122/32 |
| 3,933,654 | 1/1976 | Middelbeek | 210/521 |
| 4,036,664 | 7/1977 | Priebe | 210/521 |
| 4,079,701 | 3/1978 | Hickman et al. | 122/382 |
| 4,086,169 | 4/1978 | Skarheim et al. | 210/519 |
| 4,123,365 | 10/1978 | Middelbeek | 210/521 |
| 4,156,644 | 5/1979 | Richard | 210/19 |
| 4,303,043 | 12/1981 | Redding | 122/382 |
| 4,407,236 | 10/1983 | Schukei et al. | 122/390 |

*Primary Examiner*—Henry C. Yuen
*Attorney, Agent, or Firm*—L. A. DePaul

[57] ABSTRACT

A sludge trap, or mud drum, for use in nuclear steam generators includes internal baffles defining multiple laminar flow paths having decreased vertical settling distances. The baffling arrangements take advantage of the diverging nature of circular geometry of sludge traps such that flow path cross-sectional areas are maintained and increased in the direction of flow, to avoid undesired, detrimental flow acceleration; turbulence as well is minimized, thereby to achieve a desired quiescent environment for effective gravitational settlement of sediment and particulate matter.

8 Claims, 6 Drawing Figures

SLUDGE TRAP WITH INTERNAL BAFFLES FOR USE IN NUCLEAR STEAM GENERATOR

BACKGROUND OF THE INVENTON

This invention relates to steam generators and, more particularly, to a sludge trap, or mud drum, having internal baffles defining multiple laminar flow paths affording decreased vertical settling distances for improving the effectiveness of gravitational settlement and collection of particulate material carried by recirculating carry-over water within a nuclear-powered steam generator.

CROSS REFERENCE TO RELATED APPLICATIONS

Reference is made to pending Application Ser. No. 613,673 entitled "Modular Sludge Collection System for a Nuclear Steam Generator," filed May 24, 1984 in the name of Appleman et al. and assigned to Westinghouse Electric Corporation, the common assignee herein.

DESCRIPTION OF THE PRIOR ART

Nuclear steam generators of the type with which the present invention may be utilized are commercially available from the assignee of the present invention, namely Westinghouse Electric Corporation. U.S. Pat. Nos. 4,079,701—Hickman et al. and 4,276,856—Dent et al., each assigned to Westinghouse Electric Corporation, common assignee of the present invention, disclose shell and U-shaped tube bundle nuclear steam generators which may utilize the improved sludge trap of the present invention.

It is well known in the art of steam generators to provide certain spaces or volumes therein of relatively low velocity fluid flow to afford the opportunity for solids suspended in the fluid to settle out in an area where they can be relatively easily collected and eliminated from the generator. For example, U.S. Pat. No. 4,303,043—Redding, also assigned to Westinghouse Electric Corporation, discloses a mud drum (i.e., a sludge trap, or collection chamber) for use with the afore-described nuclear steam generators. The mud drum is interposed between the recirculating carry-over water within the steam generator and the incoming feedwater, thereby to intercept the recirculating water and retain at least a portion thereof in a substantially stagnant condition for facilitating highly concentrated, entrained solids to be deposited within the mud drum. Interior baffle means within the chamber limit the exchange of the continuously incoming carry-over water with the water already retained in the chamber, thereby to minimize turbulence while permitting a desired rate of exchange between the incoming recirculating water and the water in the chamber from which entrained solids, or sediments, have settled out within the mud drum. The interior baffles of the mud drum of U.S. Pat. No. 4,303,043 thus function to assure that the water in the chamber is resident for a sufficient time in a relatively quiescent environment, such that solids are satisfactorily settled out, prior to the water exiting the chamber for recirculation.

SUMMARY OF THE INVENTION

The sludge trap, or mud drum, of the present invention includes an internal baffle arrangement which optimizes conditions for gravitational settlement of entrained solids by affording reduced vertical settling distances and thereby minimizing the required residence time. The baffle arrangement provides for plural laminar flow paths while minimizing vertical flow and preventing turbulence at intermediate locations between the inlet to and the outlet from the sludge trap, thereby to maintain the recirculating carry-over water in a relatively quiescent condition for the required residence time to acheive a desired level of gravitational settlement of sediment, or entrained solids, from the carry-over water. Further, the baffle arrangement is configured to take advantage of the diverging nature of the circular geometry of the sludge trap, such that the cross-sectional area of each flow path and the overall system geometry are proportioned so as not to increase flow velocity.

DESCRIPTION OF THE PREFERRED EMBODIMENTS

A vertical U-tube steam generator of the type generally referred to herein is more fully described in commonly owned U.S. Pat. Nos. 4,079,701, 4,276,856, and 4,303,043, above referenced, the disclosures of which are incorporated herein by reference for a general description of such a generator. A first embodiment of a sludge trap in accordance with the invention is disclosed as incorporated in an illustrative nuclear steam generator in FIG. 1, although it will be understood that the invention is not limited to use in the specific steam generator structure as disclosed therein.

Figure 1:
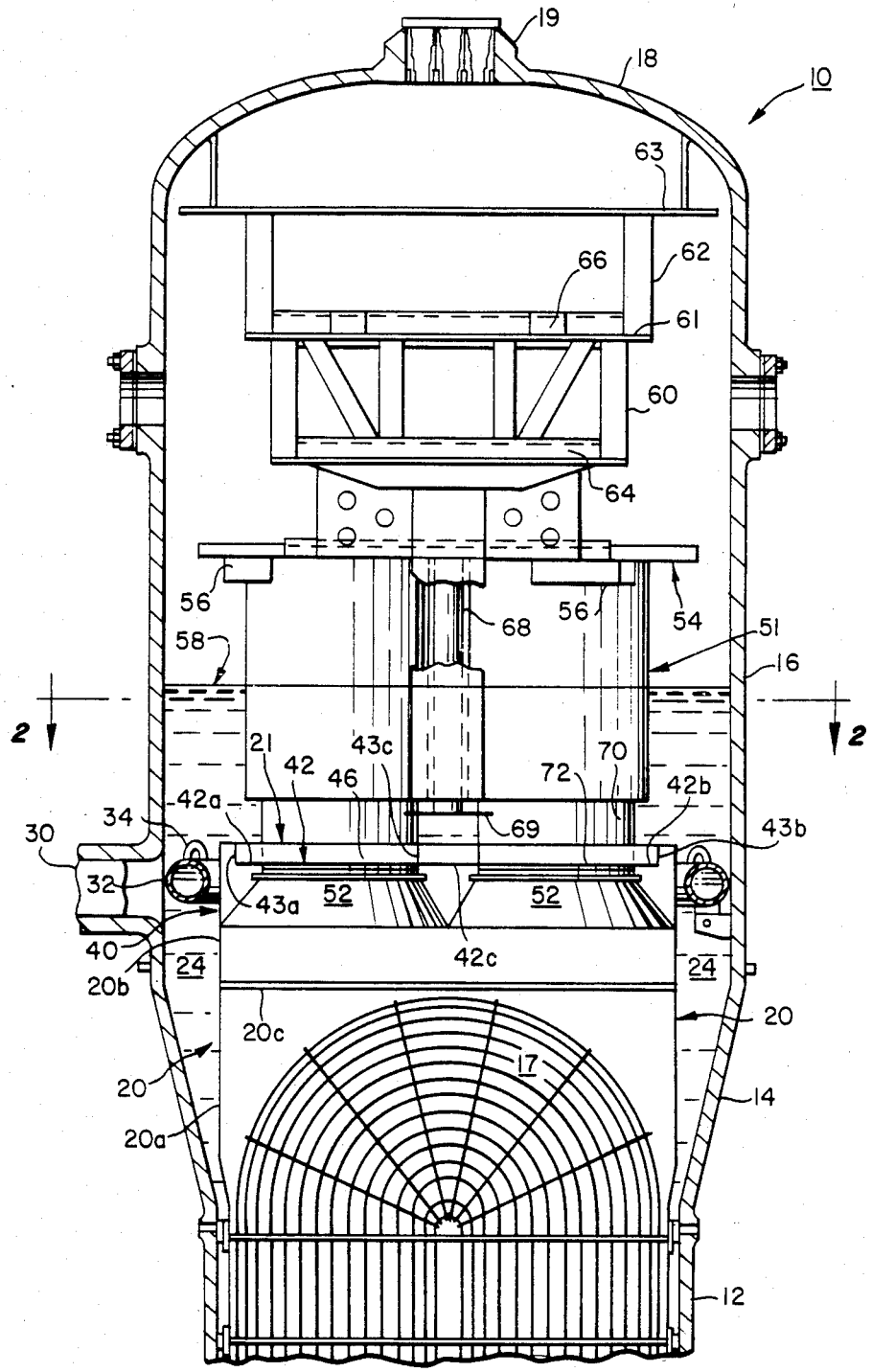
FIG. 1 is an elevational cross-sectional view of the upper portion of a steam generator.
Figure 2:
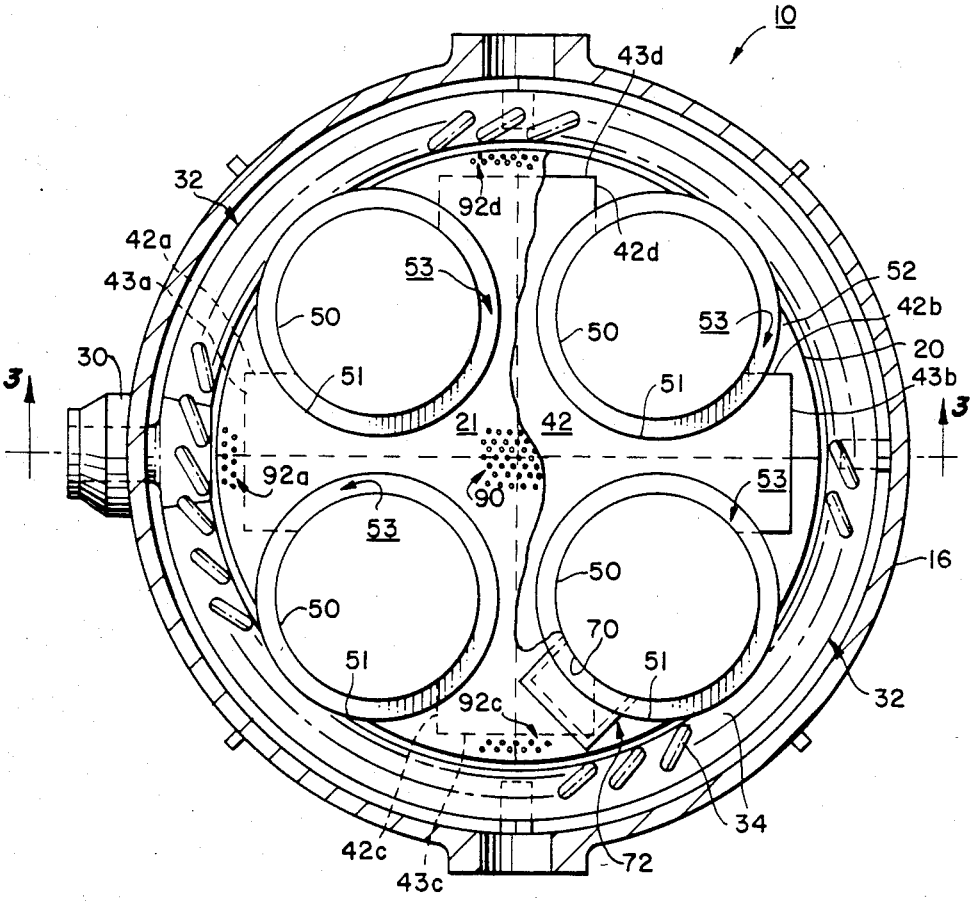
FIG. 2 is a cross-sectional view of a steam generator taken along the line 2—2 in FIG. 1.

With concurrent reference to FIG. 1 and the cross-sectional view thereof in FIG. 2 taken along line 2—2 in FIG. 1, the nuclear steam generator, generally referred to as 10, comprises a lower shell 12 connected to a frustoconical transistion shell 14 which connects lower shell 12 to a larger diameter upper shell 16. A dished head 18 having a steam nozzle 19 disposed thereon encloses upper shell 16. Disposed within the shells 12 and 14 and extending into the lower reaches of the upper shell 16, in annular, spaced relationship, is a generally cylindrical inner wrapper 20, which in turn encloses the U-tube bundle 17. The inner wrapper 20 and the associated outer shells 12 and 14 define an annular fluid flow chamber 24.

A secondary fluid, or feedwater, inlet nozzle 30 is formed in the wall of the upper shell 16 adjacent the transistion shell portion 14, and communicates with a feedwater header, or ring, 32 which extends about the inner circumference of the upper shell 16 and supports a plurality of J-nozzles 34 which direct feedwater downwardly into the chamber 24. In operation, feedwater enters steam generator 10 through feedwater inlet nozzle 30, flows through the header 32 and is discharged through the J-nozzles 34. The greater portion of the feedwater exiting the J-nozzles 34 flows downwardly through chamber 24 to the enclosed bottom portion (not shown) of the steam generator 10, whereupon the feedwater is directed generally radially inwardly to come into heat-exchange relationship with the tube bundle 17. Heated reactor coolant recirculates continuously through the reactor core, for being heated, and the tube bundle 17, for heating the feedwater. The heated feedwater rises by natural circulation up through the tube bundle 17 and is heated thereby until converted to steam, in a manner well known in the art.

The upper end of the wrapper 20 is enclosed by an upper cover, or wrapper head 21; as is conventional, the wrapper 20 may be formed of a lower portion 20*a* and an upper portion 20*b* integrally joined along seam 20*c*. The sludge trap 40 thus is formed within the upper portion 20*b* of the wrapper 20 and includes the wrapper head 21 and other components, now to be described. Significantly, in accordance with the first embodiment of the sludge trap of the invention as is shown in FIG. 1, the sludge trap 40 includes an interior baffle 42 comprising a generally horizontal plate having orthogonally related radial extensions 42*a*, 42*b*, 42*c*, and 42*d* with respectively corresponding, integral upright elements 43*a*, 43*b*, 43*c*, and 43*d* which are secured to the cover 21 and depend vertically therefrom to support the baffle 42.

With reference to the upper portion of the steam generator 10 generally contained within the upper shell 16, a plurality of riser sleeves 50 are disposed on wrapper head 21, extending therethrough and through the horizontal baffle 42 to be joined integrally with respective riser transition cones 52. Each of the riser transition cones 52 is of a complex geometric configuration, extending from a lower perimeter comprising a 90° arcuate segment outer edge and two right-angled inner edges, upwardly to the lower, circular ends of the riser sleeves 50. The contiguous, right-angled edges of adjacent cones 52 are integrally joined to each other, and the arcuate segment outer edges thereof are joined integrally to the contiguous inner surface of the upper wrapper portion 20*b*. Thus, steam that is produced from the feedwater rises from the top of the tube bundle 17 and ascends through the transition cones 52 and the riser sleeves 50, progressing upwardly through the steam generator 10 and ultimately exiting therefrom through the steam nozzle 19. The upper ends of the riser sleeves 50 terminate at and are secured to a mid-deck plate 54 which is secured (by means not shown) to the upper shell 16. Also secured and depending from the mid-deck plate 54 are downcomer sleeves 51 which are coaxial with and of larger diameter than the respective riser sleeves 50, defining therebetween annular downflow fluid chambers 53. As seen in FIG. 1, the downcomer sleeves 51 are of shorter axial length than the riser sleeves 50, and thus the lower ends thereof are displaced from the wrapper head 21.

The riser sleeves 50 have disposed therein, typically, centrifugal swirl vanes (not shown) which function as a primary separator for the generator 10, for initially separating entrained water from the steam vapor passing therethrough. The separated water is centrifuged outwardly into the annular water downcomer sleeves 51 or, alternatively, to tangential nozzles 56 for discharge of the separated liquid water into the common annular chamber 24. The normal water level is shown at 58. Thus, the water separated from the steam by the primary separators within the riser sleeves 50 returns, variously, through the annular downflow fluid chambers 53 and through the tangential nozzles 56 and exteriorally of the riser sleeves 50 to the body of water retained within chamber 24. The water in chamber 24, along with fresh feed water supplied through inlet 30, header 32 and nozzles 34, then proceeds through the afore-described flow path and into heat exchange relationship with tube bundle 17 to be converted to steam.

A pair of vertically stacked chevron moisture separators 60, 62 are supported by support rings 61 and 63, respectively, and sealed thereby to the interior walls of the upper shell 16 such that the steam emerging from the primary separators within the riser sleeves 50 passes through the stacked chevron separators 60 or 62 for removal of remaining water entrained in the steam. Collecting troughs 64 and 66 collect the water separated by the chevron separators 60 and 62, respectively, and direct same to a central drain 68 which carries the separated water vertically downwardly toward the wrapper head 21. Preferably, a dispersion plate 69 is mounted on the end of the central drain 68 to prevent the return flow through the central drain 68 from directly impinging on the wrapper head 21.

Thus, steam generated from the feedwater by heat exchange with the heated coolant in the tube bundle 17 proceeds upwardly through the risers 50 containing the primary fluid separators and thereafter through the secondary separators 60 and 62 for removal of entrained water from the steam; all of the separated water ultimately is collected and returned to the chamber 24 for recirculation into further heat exchange relationship with the tube bundle 17, having been mixed in chamber 24 with newly supplied feedwater. As will be appreciated, a substantial portion of the downflow of recirculating water from the primary separators within the riser sleeves 50 and the stacked chevron moisture separators 60 and 62 is caused to flow across the wrapper head 21 in the return with to chamber 24.

The sediment, or particulate matter, which is gravitationally settled out of the recirculating feedwater which passes through the sludge trap 40 and thus collects on the horizontal surface of baffle 42 and on the inclined surfaces of the transition cones 52 must periodically be removed. This is accomplished through an access door 70 (FIG. 1) in the side wall of the riser sleeve 50 which moreover communicates with a cover plate, or trap door, 72 in the wrapper head 21.

Figure 3:
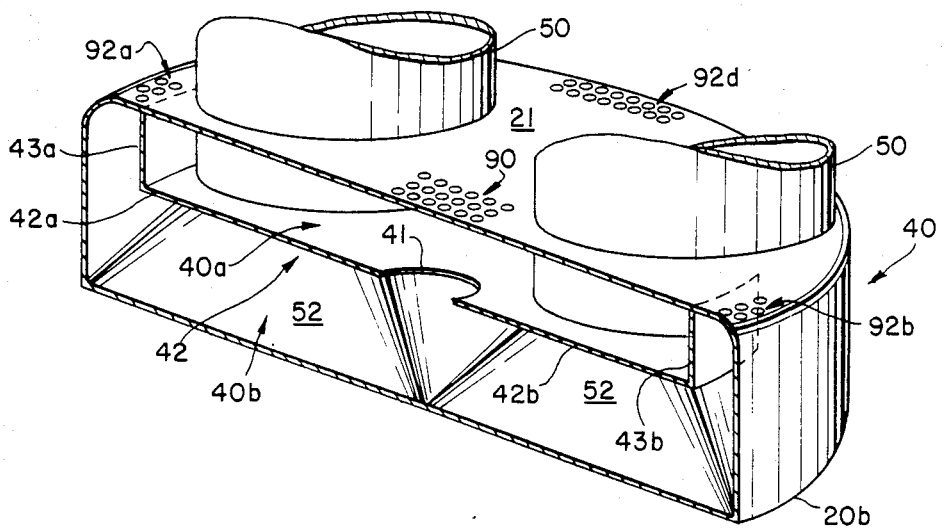
FIG. 3 is a simplified perspective view, generally shown in cross-section along line 3—3 in FIG. 2, of the sludge trap of the invention.

FIG. 3 is a simplified schematic view of the sludge trap of the invention, taken in cross-section generally along the line 3—3 of FIG. 2, to which reference is now had concurrently with FIGS. 1 and 2 to describe the fluid flow produced by the internal baffling in accordance with the present invention. Elements of the simplified presentation of FIG. 3 which correspond to those of FIGS. 1 and 2 are identified by identical numerals. As shown in FIG. 3, centrally disposed in the wrapper head 21, comprising also the top cover of the sludge trap 40, is an inlet port 90 defined by an array of apertures, or holes, 92*a*, 92*b*, 92*c*, and 92*d* for the recirculating secondary fluid. Outlet ports for the secondary fluid exiting from the sludge trap 40 are defined by corresponding apertures in the wrapper head 21, located at two pairs of diametrically opposed, orthogonal locations adjacent the perimeter of the wrapper head 21; more particularly, the ports 92*a*, 92*b*, 92*c*, and 92*d* are aligned with the center lines of the corresponding extensions 42*a*, 42*b*, 42*c*, and 42*d* and are positioned exteriorally, or radially outwardly, of the upright elements 43*a*, 43*b*,43*c*, and 43*d*, respectively. The central horizontal portion of the baffle 42 moreover has a central aperture 41 therein, aligned with the inlet ports 90. Baffle 42 thus defines upper and lower laminar flow path chambers 40*a* and 40*b*.

A selected fraction of the recirculating secondary fluid flow, as permitted by the sizes of the inlet and outlet ports 90 and 92, thus proceeds axially, vertically downwardly through the inlet port 90 into the sludge trap 40. A first portion of that flow is directed into chamber 40*a* by the baffle 42 and the remaining, second portion continues axially downwardly through the aperture 41 in the baffle 42 into chamber 40*b*; these two portions thereafter disperse generally radially outwardly toward the outer circumference of the sludge trap 40 in two upper and lower, separate laminar paths in the corresponding upper and lower chambers 40*a* and 40*b* defined by the baffle 42. These paths can be best visualized with concurrent reference to FIGS. 2 and 3. The laminar flow in the upper chamber 40*a* extends radially outwardly along the baffle 42, diverging into four generally mutually orthogonal paths through the spaces intermediate of, and defined by, the side walls of adjacent pairs of riser sleeves 50, the wrapper head 21 and the baffle 42. The flow in each of these paths then diverges into two sub-paths through the outlet openings defined by the edges of each of the upright elements 43*a*, 43*b*, 43*c*, and 43*d* and the adjacent side walls of the respectively adjacent riser sleeves 50. The laminar flow through the lower chamber 40*b* extends from the axis of inlet aperture 41 radially outwardly in four generally mutually orthogonal paths defined by the baffle 42 and the upper complex geometric surfaces of the respective transition cones 52, toward the outer perimeter of the sludge trap 40. The corresponding upper and lower, plural laminar flow paths then are joined in the vicinity of the upright elements 43*a*, 43*b*, 43*c*, and 43*d* to exit through the outlet ports 92*a*, 92*b*, 92*c*, and 92*d*, respectively.

The rate of flow and related residence time in each of the flow paths is designed so as to achieve effective and efficient gravitational settlement of sediment within the sludge trap 40, and particularly onto the upper horizontal surface of baffle 42 and the upper surfaces of the transition cones 52. Thus, the secondary fluid exiting from the sludge trap 40 has had removed therefrom a desired amount of particles of prescribed sizes, as may have been initially entrained within the secondary fluid. The thus purified secondary fluid enters chamber 24, and is mixed therein with secondary fluid previously separated and collected therein and the newly introduced feedwater, or secondary fluid, and recirculated into heat exchange relationship with the tube bundles 17.

To achieve effective removal of sediment, or entrained solids, from the secondary fluid, various parameters must be taken into consideration in the design of the baffling arrangement. A parameter of primary importance is the vertical settling distance; particularly, the invention permits minimizing the vertical settling distance thereby to minimize the required residence time to achieve gravitational settlement of particulate matter of a given range of sizes in accordance with which the design criterion for sediment removal has been established. As is well known, the finer the particulate matter, the longer the residence time required to achieve gravitational settlement under relatively quiescent conditions. Higher rates of velocity, on the other hand, if coupled with longer settling paths, will permit adequate settlement of higher mass particulate matter, but lower mass particulate matter may not settle out and instead remain entrained. Thus, design criterion must take into account the maintenance of adequate cross-sectional area of flow, whether through a single or plural paths, such that the permissible maximum velocity is not exceeded, consistent with the required residence time of the fluid within the sludge trap, and the selected vertical settling distance, such that gravitational settlement of the particulate matter for a given range of particle mass and size, consistent with the design criterion, is achieved.

These parameters are interrelated in accordance with the following expressions:

Where $h_s$ represents efficiency of settling and E represents the efficiency of a sludge trap in a given steam generator installation:

$$h_s = \frac{V_s \times L}{H \times V_B} \tag{1}$$

where:

$V_s$=particle settling (vertical) velocity (ft/sec)
L=length of flow path (i.e., for settling)
H=settling (vertical) distance, or height (ft)
$V_B$=flow velocity (ft/sec)

$$E = \frac{\text{volumetric flow through sludge trap}}{\text{volumetric flow through steam generator}} \times h_s \tag{2}$$

The efficiency E of the sludge trap for a given steam generator installation of course depends, in accordance with the expression (2), on the ratio of the volumetric flow of secondary fluid through the sludge trap to the total volumetric flow of secondary fluid through the steam generator. In typical installations, this ratio is approximately 2% and thus:

$$E \approx 0.2\ h_s \tag{3}$$

Applying the foregoing relationships to the specifically disclosed sludge trap 40 shown in FIGS. 1 through 3, the steam generator 10 may have an upper shell 16 of approximately 248 inches height and an inside diameter of approximately 190 inches, a transition shell 14 of approximately 76 inches height, a lower shell 12 of an internal diameter of about 152 inches, and an upper wrapper portion 20*c* of an internal diameter of approximately 154 inches The riser sleeves 50 may have a common outside diameter of approximately 52 inches and the downcomer sleeves 52, a common outside diameter of approximately 63 inches, defining a downcomer annulus 53 of approximately 4 inches, measured radially (allowing for material thickness of the sleeves 50 and 51). The coaxial sleeves 50 and 51 are spaced at centers displaced by approximately 70 inches from each other, equiangularly oriented in respective quadrants, such that the riser sleeves 50 on their external surfaces are contiguous with or close to the internal surface of the upper portion 20*b* of wrapper 20. The total rate of flow of secondary fluid (i.e., both fresh feedwater supplied through inlet nozzle 30 and the recirculating carry-over water) through the steam generator 10 of the specified dimensions typically may be approximately $16\times10^6$ pounds per hours (lb/hr), producing approximately $4\times10^6$ lb/hr of steam. Thus, there is a flow or recirculating secondary fluid of approximately $12\times10^6$ lb/hr across the wrapper head 21. The sludge trap 40 accordingly may have a total vertical, or axial height of approximately 26 inches, as measured between the lower edge of the transition cones 52 and the wrapper head 21; the baffle 42 then may be spaced approximately 6 inches below the wrapper head 21. The rate and volume of flow through the sludge trap 40 is controlled by the number and size of the apertures comprising the inlet port 90 and the outlet ports 92, and typically is approximately 2% of the flow thereacross (i.e., $12\times10^6$ lb/hr), or $2.4\times10^5$ lb/hr. In the installation of FIG. 2, the inlet port 90 comprises 65 apertures, each of $\frac{3}{4}$ inch diameter, and the outlet ports 92*a*, 92*b*, 92*c*, and 92*d* each comprise 16 apertures of $\frac{3}{4}$ inch diameter.

While the foregoing dimensions and flow rates are illustrative of one practical application of the invention, it is to be understood that they are not limiting in any absolute sense, but are intended to indicate the approximate relative relationships which are effective in the design of practical implementations of the present invention. As those of skill in the art will appreciate, the number, and correspondingly the diameters, of the riser sleeves 50 and related structures (e.g., the downcomer sleeves 51) are not critical but are selected from practical design requirements. For example, a much larger number of correspondingly smaller diameter risers than the four (4) shown in FIGS. 1 to 3 could be employed in the alternative, proportioned to satisfy the flow rates required in any given installation.

It is also important that the cross-sectional area of flow not be unduly constricted in any particular location, such that the velocity or rate of flow is not increased to an unacceptable level. Thus, particularly from FIGS. 2 and 3, it can be seen that each of the four flow paths in the upper chamber 40*a* has a minimum cross-sectional area at the position between the side walls of the riser sleeves 50, and successive passageway areas thereafter in each flow path are of increasing cross-sectional area. It likewise can be seen that each of the flow paths through the lower chamber 40*b* defined by the baffle 42 and the upper surfaces of the transition cones 52 proceeds through ever-increasing cross-sectional areas from the central position underlying aperture 41 toward the circumferance of the sludge trap 40. The baffle of the present invention thus takes advantage of the diverging nature of the circular geometry of the basic sludge trap configuration, as well as the configuration and positions of the riser sleeves 50 and their associated transition cones 52, to afford desired cross-sectional flow areas satisfying the above criteria. Moreover, the relationship of the flow rate permitted by the inlet and outlet ports 90 and 92 to the total recirculating carry-over water flow rate assures maintaining sufficiently low flow rates within the sludge trap 40, such that the required, quiescent resident time of the secondary fluid is achieved, given the vertical spacing of the elements defining the chambers 40*a* and 40*b* and thus their respective settling distances, such that particles of a particular size, or range of sizes, are successfully settled out. As will be understood, the design criterion is selected based on experience factors, and takes into account measured data and statistical variations; thus a design criterion of achieving substantially complete precipitation, and thus removal, of particles of 16 microns or larger size, based on analysis of contaminants in the recirculating feedwater, would allow for maximum efficiency in precipitation in the sludge trap 40 of particles of that size or larger, typically over a range of particle sizes from 16 microns up to 30 microns (still larger particles typically not being carried by the feedwater and instead precipitating directly), and with progressively lower degrees of efficiency of precipitation of particles of decreasing sizes below 16 microns.

Figure 4:
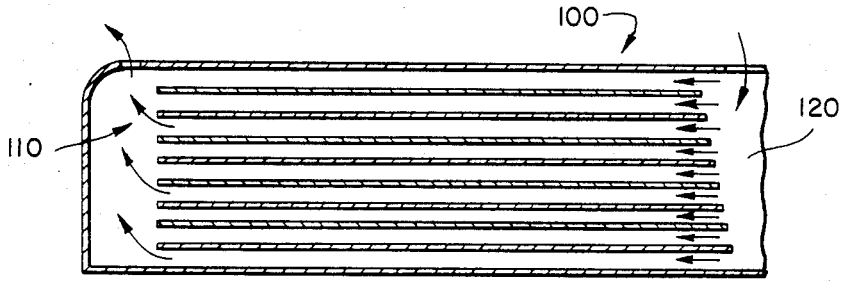
FIG. 4 is a schematic, partial elevational view, shown in cross-section taken along a diameter, such as the line 3—3 in FIG. 2, of a sludge trap in accordance with a further embodiment of the invention.

FIG. 4. is a simplified plan view, in partial cross-section, of a baffling arrangement for a sludge trap 100 of a geometric design similar to that of the sludge trap 40 of FIGS. 1, 2, and 3. As shown schematically therein, a plurality of baffles 110 are provided, thereby defining plural horizontal chambers having greatly reduced vertical settling distances while maintaining substantially the same total cross-sectional flow area so as not to increase flow velocity, and which increases with increasing radial distance toward the outer circumference. This structure thus permits reduced path lengths for a given flow velocity and range of particle size desired to be gravitationally settled.

With the multiple laminar flow paths afforded by the structure of FIG. 4, the corresponding central apertures shown at 120 in the successively lower baffles 110 are proportionately decreased in their respective cross-sectional areas, to provide the appropriate volumetric flow rate in each of the successively lower laminar flow paths. This structure also takes advantage of the diverging nature of circular geometry, as achieved in the sludge trap 40 of FIGS. 1, 2, and 3. It is important as well that in the baffle arrangement of FIG. 4, vertical flow has not been significantly increased over that which naturally occurs in a sludge trap of corresponding outer dimensions but which lacks the laminar-flow baffling arrangement of the present invention. Of course, since the thickness of the baffle plates 110 in FIG. 4 may be deemed negligible relative to the height of the sludge trap, substantially the same total flow cross-sectional area is afforded in the structure of FIG. 4 as in that of FIG. 3, for example, whereby in view of the reduced vertical settling distance, the structure of FIG. 4 affords greater efficiency and removal of a wider range of masses of particulate material than that of FIG. 3.

Figure 5:
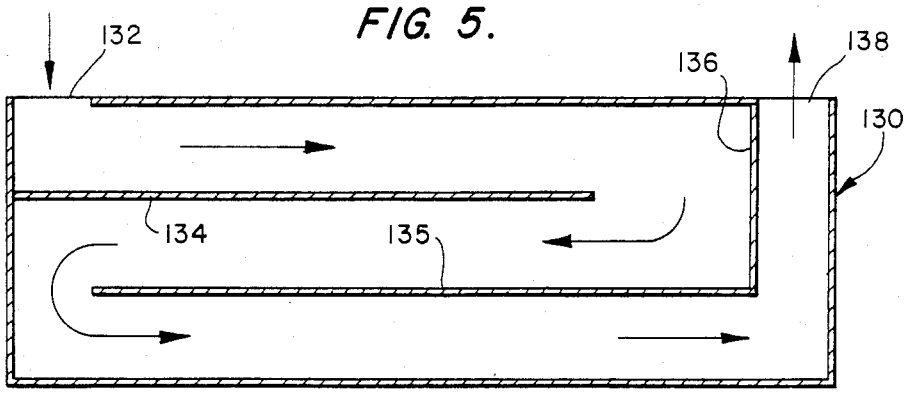
FIG. 5 is a schematic, partial elevational view, shown in cross-section, of yet a further embodiment of a sludge trap in accordance with the invention.

FIG. 5 is a schematic, partial elevational view, shown in cross-section in a manner substantially similar to that of FIG. 4, of yet a further embodiment of a sludge trap in accordance with the invention. The cross-sectional view is taken along only a radius (i.e., not a diameter) of the generally cylindrically-shaped sludge trap 130. Particularly, the sludge trap 130 of FIG. 5 includes an inlet port 132 which may be a multiple-apertured inlet as shown at 90 in FIG. 3, and internal, radially extending horizontal baffles 134, 135 and 136 which provide decreased settling distances, as compared to a sludge trap lacking internal baffling but having the same exterior dimensions, while additionally increasing the path length. It should also be appreciated that by the provision of a central inlet port 132 along the axis of the sludge trap 130 and plural outlet ports 146 (of which only one is shown) disposed adjacent the outer periphery of the cylindrical sludge trap 130, the sludge trap 130 takes advantage of the diverging nature of circular geometry, as before described. Particularly, the baffles 134, 135 and 136 are positioned so as to provide successively larger cross-sectional flow path areas thereby to avoid any undesired acceleration of the flow.

Figure 6:
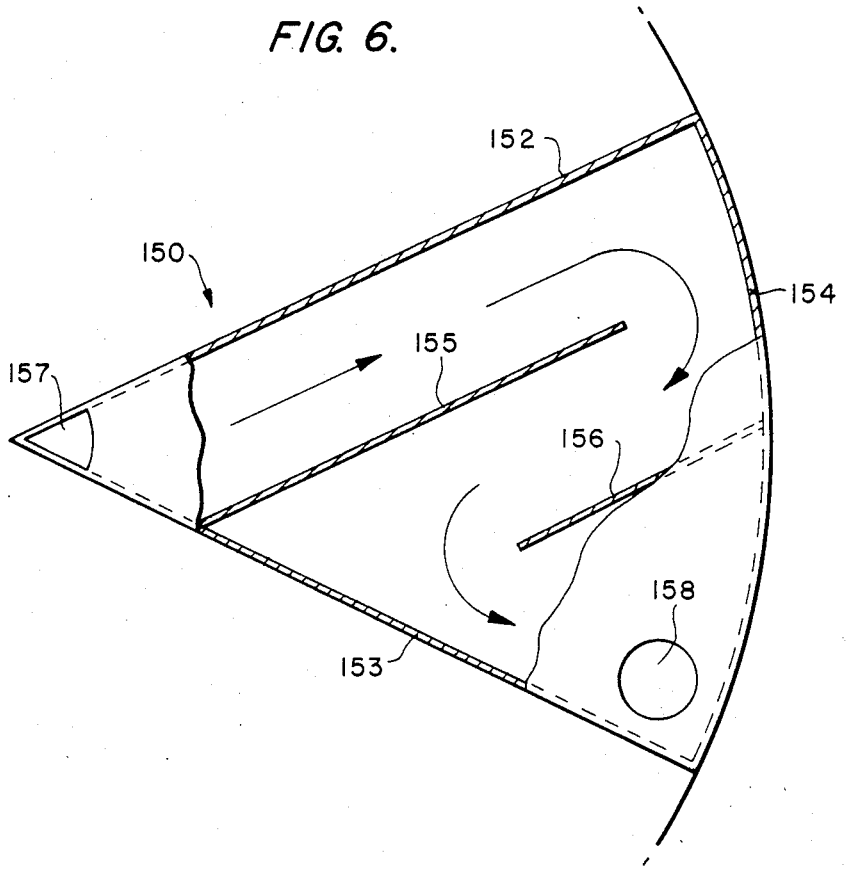
FIG. 6 is a schematic, partially broken away plan view (as in FIG. 2) of an arcuate segment of a sludge trap in accordance with yet another embodiment of the invention.

FIG. 6 is a schematic, partially broken-away plan view of an arcuate segment of a sludge trap 150 in accordance with yet another embodiment of the invention. Particularly, FIG. 6 illustrates an arcuate segment, only, of a generally cylindrical sludge trap such as that of FIG. 2, each arcuate segment defining a chamber for a single, horizontal laminar flow; thus, a plurality of segments would be employed in each level and plural interconnected levels would be employed in the composite sludge trap. The structure of FIG. 6 thus achieves plural laminar flows as are afforded, for example, in the structure of FIG. 4. The structure of FIG. 6 moreover affords an increased flow length while utilizing the advantages of the diverging nature of circular geometry to satisfy the cross-sectional flow area criterion described above. Particularly, the arcuate-segment sludge trap 150 of FIG. 6 includes radial side walls 152 and 153 and an arcuate outer wall segment 153 comprising a portion of of the generally cylindrical wrapper of the sludge trap 150. Internal baffles 155 and 156 extend in parallel to the first radial wall 152, the first baffle 155 being secured to the second radial side wall 153 and the second baffle 156 being secured to and extending inwardly from the arcuate outer wall segment 154. It can be seen that by appropriate proportioning of the size and proper positioning of the baffles 155 and 156, the flow path cross-sectional area is maintained consistent with the above criterion.

In conclusion, the internal baffling arrangement for sludge traps as afforded by the present invention provides reduced settling distances for sediment carried by the secondary recirculating fluid in a steam generator, and thus increases the effectiveness of sediment removal by gravitational settlement while permitting use of reduced flow path length and residence time. By taking advantage of the diverging nature of the circular geometry, flow path cross-sectional areas are maintained and increased in the direction of flow, thereby to avoid undesired, detrimental flow acceleration; turbulence as well is minimized, thereby to achieve a desired quiescent environment for effective gravitational settlement of sediment and particulate matter from the secondary fluid. While several specific embodiments of the invention have been disclosed herein which afford the foregoing benefits, it is believed that numerous other internal baffling configurations and orientations will be apparent to those of ordinary skill in the art and thus it is intended by the appended claims to cover all such modifications and adaptations which fall within the spirit and scope of the invention.

I claim as my invention:

1. A sludge trap for a vertically oriented steam generator having a flow path therein through which a secondary liquid supplied to the generator flows for heating and conversion to a vapor which is discharged from the generator, and including means for separating liquid entrained in the vapor prior to discharge of the vapor and means for collecting the separated liquid and mixing the separated liquid with other secondary liquid in the generator for recirculation thereof through the flow path, said sludge trap receiving a portion of said collected, separated liquid prior to mixing thereof with other secondary liquid for recirculation and comprising:

a generally cylindrical sidewall having upper and lower ends;

upper and lower enclosures integrally joined to the respective upper and lower ends of said cylindrical sidewall, said upper enclosure including a centrally disposed inlet port for receiving therethrough said portion of said collected and separated liquid, and plural output ports disposed adjacent the periphery thereof thorough which the received liquid exits from said sludge trap; and baffle means disposed generally horizontally within said sludge trap intermediate said upper and lower enclosures thereof for defining, and for distributing secondary liquid received through said inlet port proportionately into, plural laminar flow path chambers within said sludge trap communicating between said inlet and outlet ports, each said chamber defining a reduced vertical settling distance for particulate matter entrained in said received secondary liquid and a diverging cross-sectional flow path area in prdceeding toward said outlet ports, and wherein said baffle menas includes first and second horizontal baffle plates positioned in spaced relationship between said upper and lower enclosures, said first baffle plate extending from the center of said sludge trap toward said cylindrical sidewall and having an outer, arcuate edge of a first radial dimension less than the radial dimension of said cylindrical sidewall, and said second horizontal baffle plate being of annular configuration and having an outer arcuate edge of a second radial dimension intermediate the radial dimension of siad first horizontal baffle plate and the radial dimension of said cylindrical sidewall, and a vertical, arcuate-segment baffle plate extending from the outer arcuate edge of said second horizontal baffle plate to said upper enclosure in concentric relationship with said cylindrical sidewall, said first horizontal baffle plate defining with said upper enclosure a first, radially outward flow path chamber extending from said first inlet port, said first and second baffle plates defining therebetween a second, radially inward flow path chamber, and said second horizontal baffle plate defining with said lower enclosure, a second radially outward flow path chamber, said vertical arcuate-segment baffle plate defining, at the inner radial side thereof, a flow path connection between said first and second flow path chambers and defining, in the spacing between the outer radial side thereof and said cylindrical sidewall of said sludge trap, an exit flow path communicating between said second radially outward flow path chamber and said outlet ports of said sludge trap.

2. A sludge trap for a vertically oriented steam generator having a flow path therein through which a secondary liquid supplied to the generator flows for heating and conversion to a vapor which is discharged from the generator, and including means for separating liquid entrained in the vapor prior to discharge of the vapor and means for collecting the separated liquid and mixing the separated liquid with other secondary liquid in the generator for recirculation thereof through the flow path, said sludge trap receiving a portion of said collected, separated liquid prior to mixing therof with other secondary liquid for recirculation and comprising:

a generally cylindrical sidewall having upper and lower ends;

upper and lower enclosures integrally joined to the respective upper and lower ends of said cylindrical sidewall, said upper enclosure including a centrally disposed inlet port for receiving therethrough said portion of said collected and separated liquid and plural output ports disposed adjacent the periphery thereof thorough which the received liquid exits from said sludge trap; and baffle means comprising at least one baffle plate, disposed generally horizontally within said sludge trap intermediate said upper and lower enclosures thereof, for defining, and for distributing secondary liquid received through said inlet port proportionately into, plural laminar flow path chambers within said sludge trap communicating between said inlet and outlet ports, each said chamber defining a reduced vertical settling distance for particulate matter entrained in said received secondary liquid and a diverging cross-sectional flow path area in proceeding toward said outlet ports, each said baffle plate including a central portion and plural radial extensions extending from said central portion to corresponding positions adjacent said cylindrical sidewall and defining, with respect thereto, upper and lower laminar flow path chambers within said sludge trap; said outlet ports correspond in number to said radial extensions and are disposed in said upper enclosure at respectively corresponding positions adjacent said cylindrical sidewall; and each said baffle plate includes an aperture in said central portion thereof for distributing a predetermined proportion of the secondary liquid received in said respective upper laminar flow path chamber into said respective lower laminar flow path chamber.

3. A sludge trap as recited in claim 2, wherein:

said steam generator includes a plurality of risers each having upper and lower open ends, said risers being disposed vertically in parallel axial, spaced relationship within said steam generator and extending at the lower ends thereof through and in sealed relationship with said upper and lower enclosures; and said central portion of each said baffle plate extends to the adjacent peripheries of said plurality of risers and said plural radial extensions thereof extend from said central baffle plate portion between adjacent, corresponding ones of said risers contiguous to the respective, adjacent peripheral surface portions thereof, so as to define plural, angularly displaced laminar flow paths in each of said upper and lower chambers.

4. A sludge trap as recited in claim 3, wherein each of said risers is of generally cylindrical configuration and the plurality thereof are spaced apart equi-angularly with their axes disposed at a common radial distance from the central axis of said steam generator, said plural laminar flow paths thereby being equi-anglarly displaced in each of said upper and lower chambers.

5. A sludge trap as recited in claim 2, wherein each radial extension of each said plate includes a vertical end segment displaced radially inwardly of said cylindrical sidewall and engaging said upper enclosure, for supporting said plate intermediate said upper and lower enclosures of said sludge trap.

6. A sludge trap as recited in claim 2, wherein said baffle means comprise a plurality of said baffle plates disposed in vertically spaced positions intermediate said upper and lower enclosures for defining a plurality of laminar flow path chambers including an upper laminar flow path chamber intermediate a topmost said plate and said upper enclosure, a lower laminar flow path chamber intermediate the lowermost said plate and said bottom enclosure, and a further laminar flow path chamber intermediate each pair of adjacent said plates, successive said plates from said uppermost to said lowermost plate having apertures disposed in the central portions thereof of successively decreasing area, for proportionately distributing secondary liquid received through said inlet port of said sludge trap into the successive, plural laminar flow path chambers.

7. A sludge trap for a vertically oriented steam generator having a flow path therein through which a secondary liquid supplied to the generator flows for heating and conversion to a vapor which is discharged from the generator, and including means for separating liquid entrained in the vapor prior to discharge of the vapor and means for collecting the separated liquid and mixing the separated liquid with other secondary liquid in the generator for recirculation thereof through the flow path, said sludge trap receiving a portion of said collected, separated liquid prior to mixing thereof with other secondary liquid for recirculation and comprising:

a generally cylindrical sidewall having upper and lower ends;

upper and lower enclosures integrally joined to the respective upper and lower ends of said cylindrical sidewall, said upper enclosure including a centrally disposed inlet port for receiving therethrough said portion of said collected and separated liquid and plural output ports disposed adjacent the periphery thereof thorough which the received liquid exits from said sludge trap; and baffle means disposed generally horizontally within said sludge trap intermediate said upper and lower enclosures thereof for defining, and for distributing secondary liquid received through said inlet port proportionately into, plural laminar flow path chambers within said sludge trap communicating between said inlet and outlet ports, each said chamber defining a reduced vertical settling distance for particulate matter entrained in said received secondary liquid and a diverging cross-sectional flow path area in proceeding toward said outlet ports, said plural laminar flow path chambers including at least upper and lower laminar flow path chambers and a plurality of angular segment flow path chambers in each of said upper and lower chambers, each said arcuate segment flow path chamber being associated with a corresponding one of said outlet ports and comprising first and second vertical sidewalls extending radially to said cylindrical sidewall and a third sidewall comprising the corresponding, arcuate segment of said cylindrical sidewall extending between said first and second vertical sidewalls, and interior baffle means within said arcuate segment flow path chamber defining an elongated flow path of increasing cross-sectional area extending from said inlet port to said respective, corresponding outlet port.

8. A sludge trap as recited in claim 7, wherein said interior baffle means include first and second interior, vertical baffle plates extending parallel to said first radial sidewall, the first interior baffle plate being connected at one end thereof to the second radial sidewall and the second end thereof being displaced from said third sidewall, and the second interior baffle plate being connected at one end thereof to said third sidewall and the second end thereof being displaced from said second radial sidewall, the said displacements of said second ends of the respective first and second interior baffle plates affording openings for said flow path to reverse directions to afford said elongated flow path and said first and second interior baffle plates being disposed to define a diverging flow path cross-sectional area, in proceeding from said inlet port to said outlet port.

* * * * *